US005746682A

United States Patent [19]

Hung

[11] Patent Number: 5,746,682

[45] Date of Patent: May 5, 1998

[54] FOLDING DEVICE FOR TREADMILL

[76] Inventor: Michael Hung, 9-16, Nan Kan Hsia, Nan Kan, Lu Chu Tao Yuan County, Taiwan

[21] Appl. No.: 685,563

[22] Filed: Jul. 24, 1996

[51] Int. Cl.[6] ..... A63B 22/02

[52] U.S. Cl. ..... 482/54; 422/51

[58] Field of Search ..... 482/54, 51, 52, 482/70, 71

[56] References Cited

U.S. PATENT DOCUMENTS

| | | | |
|---|---|---|---|
| D. 207,541 | 5/1967 | Hesen | 482/54 |
| D. 211,801 | 7/1968 | Quinton | 482/54 |
| 931,394 | 8/1909 | Day | 482/54 |
| 3,731,917 | 5/1973 | Townsend | 482/54 |
| 4,679,787 | 7/1987 | Guilbault | 482/54 |
| 4,757,987 | 7/1988 | Allemand | 482/54 |
| 5,662,557 | 9/1997 | Watterson et al. | 482/54 |

*Primary Examiner*—Lynne A. Reichard
*Attorney, Agent, or Firm*—Wenderoth, Lind & Ponack

[57] ABSTRACT

A folding device for treadmill, particularly a easy and ready-to-fold folding device to fold handle frame on treadmill so that the handle frame can be folded to the surface of treadmill body to minimize packing volume and transportation cost as well as to save space requirement for storage.

1 Claim, 4 Drawing Sheets

FOLDING DEVICE FOR TREADMILL

BACKGROUND OF THE INVENTION (a) Field of the Invention

The present invention is related to a folding device for treadmill, particularly a design which cad fold treadmill easily and promptly.

(b) Description of the Prior Art

Generally treadmill always has its handle frame locked or welded to a treadmill body and then it can not be folded. Therefore, to its manufacturer its volume can be reduced significantly, its parts and components have to be packed separated to ease packing and transportation, and it has to be assembled after transporting to its destination. To the consumer its large volume requires a considerable space for its storage. Hence, it is not convenient, and it is not economic in packing and transportation.

SUMMARY OF THE INVENTION

The main objective of the present invention is to provide a folding device for treadmill, particularly a easy and ready-to-fold folding device to fold handle frame on treadmill so that the handle frame can be folded to the surface of treadmill body to minimize packing volume and transportation cost as well as to save space requirement for storage.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENTS

Figure 1:
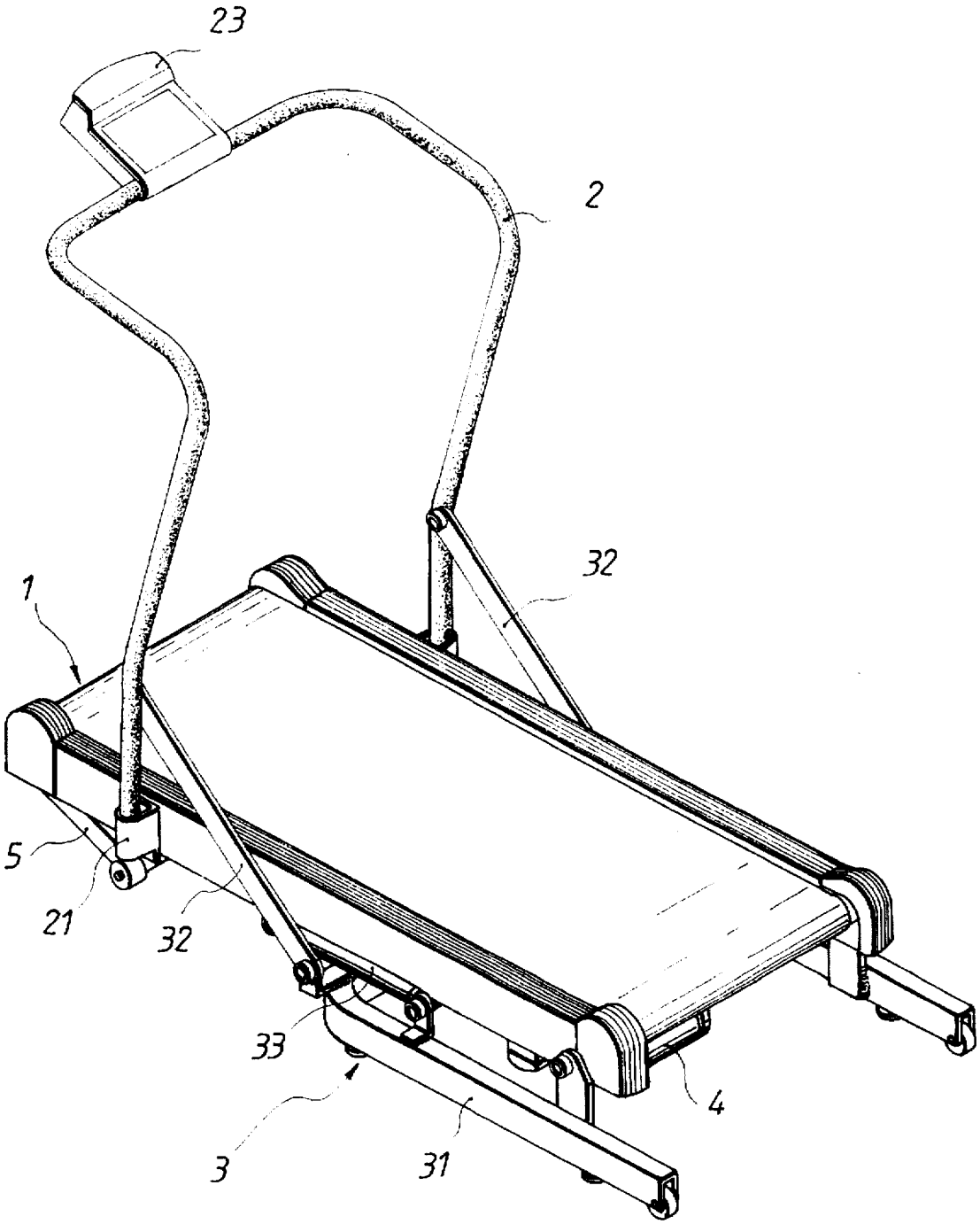
FIG. 1 is a perspective view of the folding device for treadmill according to the present invention.
Figure 2:
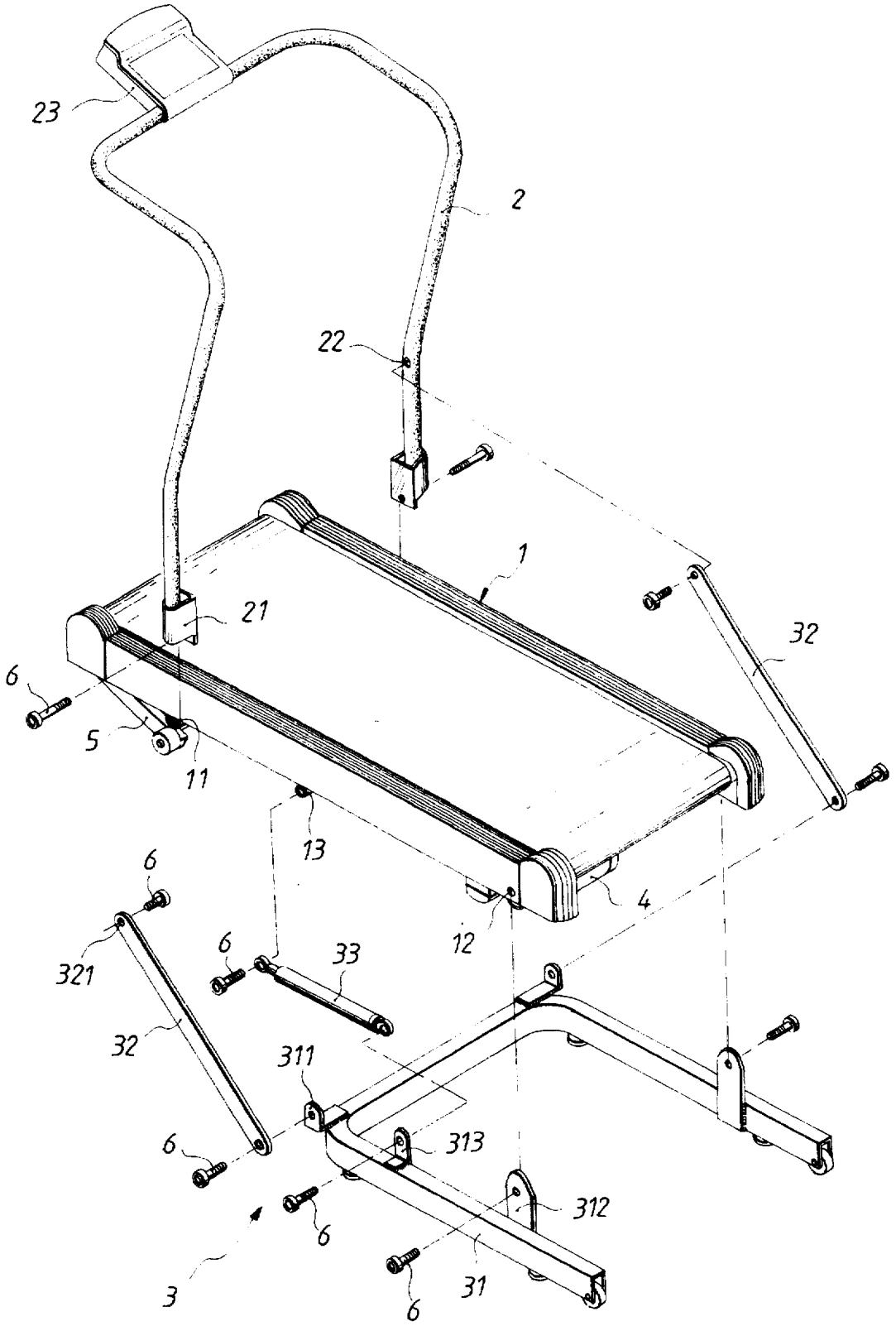
FIG. 2 is a perspective fragmented view of the folding device for treadmill according to the present invention.

As shown in FIGS. 1 and 2, the folding device for treadmill according to the present invention is a design comprising mainly a handle frame (2) and a folding device (3) on a treadmill body (1). The treadmill body (1) is equipped with a drive motor (4) and a screw rod driven angle adjuster (5). The drive motor (1) is located beneath an end of the treadmill body (1), and the screw rod driven angle adjuster (5) is hinged at both front and read ends of the treadmill body (1). However, as the structure and operation of the screw rod driven angle adjuster (5)are not the characteristics of the present invention, it is not to be described in detail here.

The treadmill body (1) has two pivot holes (11) located symmetrically beneath two side walls at its the front end, two screw holes (12) arranged symmetrically at appropriate positions on the two side walls at its rear end, a connection hole (13) between a pivot hole (11) and a screw hole (12) at a position beneath the two side walls, and a plurality of buffer block (14) within the treadmill body (1).

The handle frame (2) is fixed with a pipe socket (21) at each end and locked to a pivot hole (11) formed on the treadmill body (1) with a bolt (6), has a locking hole (22) at an appropriate location on each side pipe, and incorporated with a control panel (23) at the middle of its traverse bar section.

The folding device (3) includes a U-like base (31) welded with an L-like hinging plate (311) at the front end and a pivoting plate (312) at the rear end of each side, a hinge plate (313) between the L-like hinging plate (311) and the pivoting plate (312) at an appropriate position on one side. Each of the pivoting plates (312) is movably connected to a screw hole (12) at each side of the treadmill body (1) by means of a screw (6), while two links (32) have the holes (321) at both ends movably connected to the locking hole (22) and the L-like hinging plate (311) respectively by means of screws (6), and a pneumatic or hydraulic retractable pressure bar (33) is movably connected to each connection hole (13) and the hinge plate (313) on the U-like base (31) by means of screws (6).

With the above described structure, when the handle frame (2) is kept standing vertically on the front end of the treadmill body (1), the treadmill body (1) is in expanded condition to serve as a treadmill. On the other hand, after the handle frame (2) is removed from the side walls of the treadmill body (1) by pulling it upward, the retractable pressure bar (33) activates the links (32) and consequently the handle frame (2) is folded to the surface of the treadmill body (1) promptly.

Figure 3:
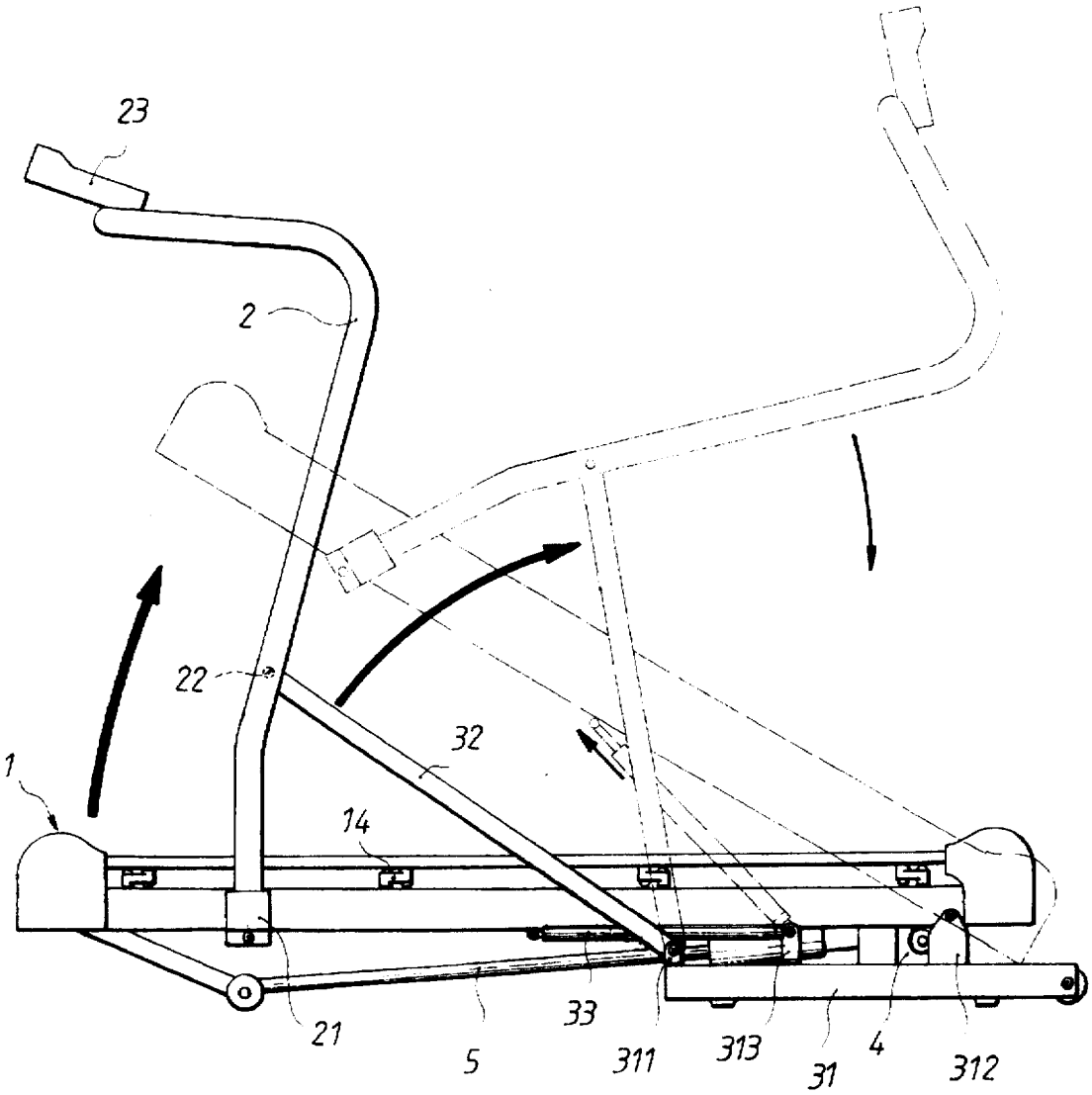
FIG. 3 illustrates action of the folding device for treadmill according to the present invention.
Figure 4:
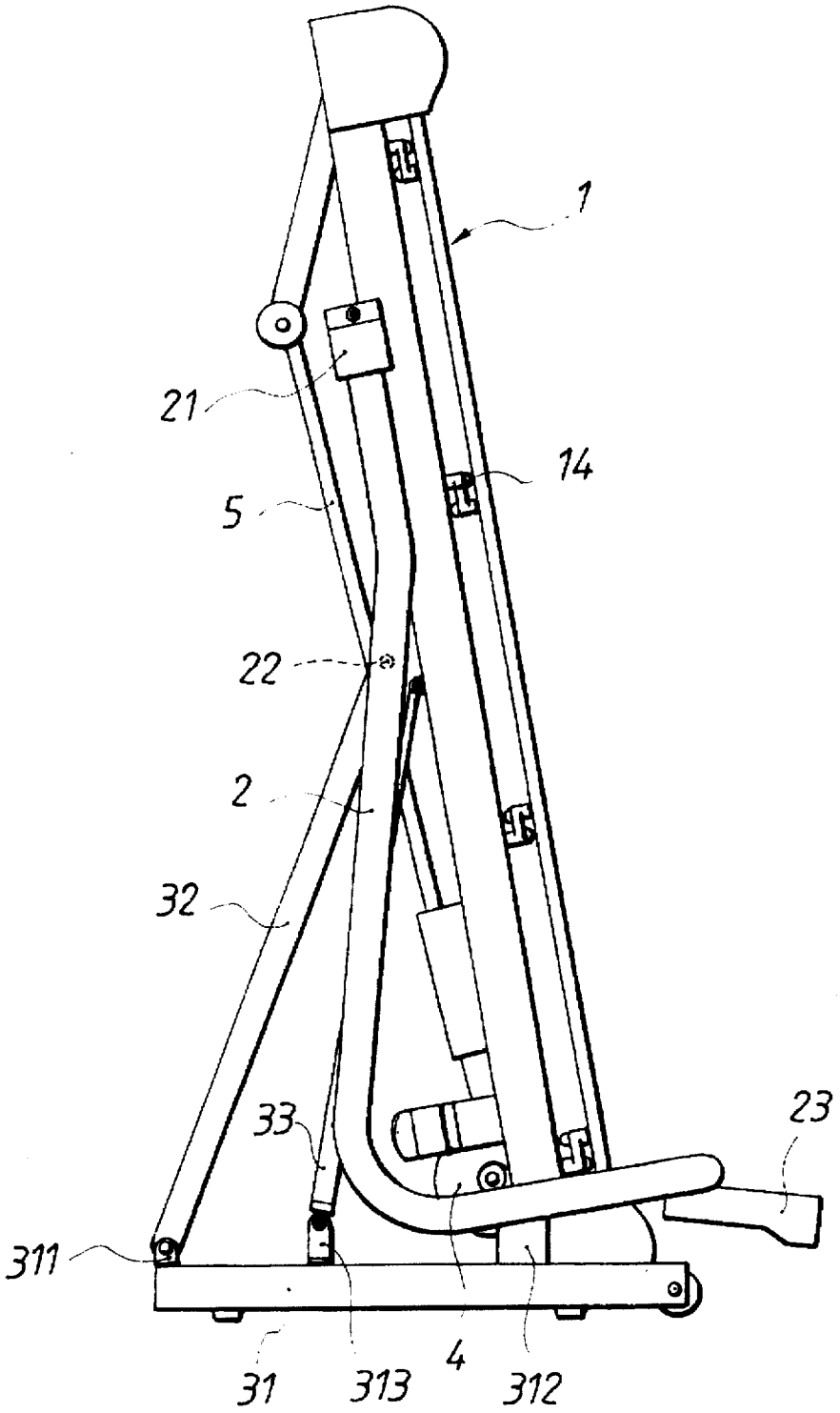
FIG. 4 illustrates vertically folding of the treadmill with the folding device according to the present invention.

Operation and effect of the folding device for treadmill according to the present invention are described in detail below. As shown in FIG. 3, a treadmill in expanded condition, the drive motor (4) is located beneath the rear end of the treadmill body (1) to facilitate separating of the handle frame (2) from the two side walls simply by pulling it upward. Upon separation of the handle frame (2) the retractable pressure bar (33) is released from compressed condition and become movable and extensible. With the gravity of the drive motor (4) located beneath the rear end of the treadmill body (1), the treadmill body (1) turns upward with the pivoting plates (312) as pivots, and simultaneously, the links (32) cause the handle frame (2) to fold to the surface of the treadmill body (1) to become a vertically folded condition as shown in FIG. 4. On the contrary, when the front end of the treadmill (1) is pressed downward to cause the retractable pressure bar to retract so that the treadmill body (1) tends to resume its horizontal position, the links (32) raise the handle frame (3) with a traction action till the pipe sockets (21) at the respective ends of the handle frame (2) is seized by the side walls of the treadmill body (1), and hence the treadmill body (1) is at expanded condition to serve as a treadmill. With such a design, an easy and ready to fold folding device for treadmill can be made to lower packing and transportation cost as well as to save space for storage.

Many changes and modifications in the above embodiment of the invention can, of course, be carried out without departing from the scope thereof. Accordingly, to promote the progress in science and the useful arts, the invention is disclosed and is intended to be limited only by the scope of the appended claims.

I claim:

1. A folding device for treadmill comprising mainly:

a treadmill body with two pivot holes located symmetrically beneath two side walls at its the front end, two screw holes arranged symmetrically at appropriate positions on the two side walls at its rear end, and a connection hole between a pivot hole and a screw hole at a position beneath the two side walls;

a handle frame fixed with a pipe socket at each end and locked to a pivot hole formed on the treadmill body with a bolt has a locking hole at an appropriate location on each side pipe; and a folding device including a U-like base (31) welded with a L-like hinging plate at the front end and a pivoting plate at the rear end of each side, a hinge plate between the L-like hinging plate and the pivoting plate at an appropriate position on one side, in which each of the pivoting plates is movably connected to a screw hole at each side of the treadmill body by means of a screw, while two links are used and having their holes at both ends movably connected to the locking hole and the L-like hinging plate respectively by means of screws, and a pneumatic or hydraulic retractable pressure bar is movably connected to each connection hole and the hinge plate on the U-like base by means of screws;

whereby the treadmill body is at an expanded condition to serve as a treadmill when the handle frame is erected vertically on the front end of the treadmill body by retaining it at the side walls, and the handle frame is folded promptly to the surface of the treadmill body by upward pulling of the handle frame to separate it from the side walls which consequently causes the retractable pressure bar to act and cause the treadmill body to stand vertically and drive the handle frame to fold to the surface of the treadmill body.

* * * * *